US007812561B2

(12) United States Patent
Hagen et al.

(10) Patent No.: US 7,812,561 B2
(45) Date of Patent: Oct. 12, 2010

(54) DEVICE FOR CONTROLLING A MOVEMENT OF FURNITURE PARTS WHICH CAN BE MOVED WITH RESPECT TO ONE ANOTHER, AND PIECE OF FURNITURE

(75) Inventors: Harald Hagen, Lustenau (AT); Thomas Nussbaumer, Lingenau (AT); Holger Wenzel, Lindau (DE); Carmelo Gutierrez, Ehringshausen (DE); Steffen Medebach, Wetzlar (DE); Jürgen Zipp, Braunfels (DE)

(73) Assignees: Grass GmbH, Hochst (AT); Kuester Automotive Door Systems GmbH, Ehringshausen (DE)

( * ) Notice: Subject to any disclaimer, the term of this patent is extended or adjusted under 35 U.S.C. 154(b) by 0 days.

(21) Appl. No.: 12/244,891

(22) Filed: Oct. 3, 2008

(65) Prior Publication Data

US 2009/0091223 A1 Apr. 9, 2009

Related U.S. Application Data

(63) Continuation of application No. PCT/EP2007/003033, filed on Apr. 4, 2007.

(30) Foreign Application Priority Data

Apr. 4, 2006 (DE) ..... 20 2006 005 581 U

(51) Int. Cl.
*B25J 9/22* (2006.01)
*G05B 19/42* (2006.01)

(52) U.S. Cl. ..... 318/568.13; 318/466; 318/468; 700/302; 312/330.1

(58) Field of Classification Search ..... 318/568.13, 318/466, 468; 700/302; 312/330.1
See application file for complete search history.

(56) References Cited

U.S. PATENT DOCUMENTS

| | | | | |
|---|---|---|---|---|
| 5,158,347 | A * | 10/1992 | Warren et al. | 312/319.8 |
| 6,109,774 | A | 8/2000 | Holmes et al. | |
| 6,685,288 | B1 | 2/2004 | MacMillan | |
| 2004/0100169 | A1 * | 5/2004 | Huber et al. | 312/319.5 |

FOREIGN PATENT DOCUMENTS

| | | |
|---|---|---|
| AT | 007 723 U1 | 6/2005 |
| DE | 101 05 756 A1 | 8/2001 |
| DE | 203 08 256 U1 | 6/2004 |

(Continued)

*Primary Examiner*—Bentsu Ro
*Assistant Examiner*—Erick Glass
(74) *Attorney, Agent, or Firm*—Burr & Brown

(57) ABSTRACT

A device for controlling the movement of furniture parts which can be moved with respect to one another, using a drive unit by means of which a first furniture part can be moved in a driven manner relative to a second furniture part via a monitoring unit for monitoring the movement of the first furniture part, in which case the monitoring unit is designed such that, after starting up, the monitoring unit operates in accordance with a monitoring program for monitoring the movement of the first furniture part, with selection means being provided by means of which an alternative selection program can be activated, instead of the monitoring program, in order to monitor the movement of the first furniture part. The invention also relates to a piece of furniture including the device.

20 Claims, 1 Drawing Sheet

FOREIGN PATENT DOCUMENTS

| | | | |
|---|---|---|---|
| DE | 20 2004 007 170 | U1 | 9/2004 |
| DE | 20 2004 016 265 | U1 | 3/2005 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 363 | A1 | 7/2003 |
| EP | 1 323 364 | A1 | 7/2003 |
| EP | 1 374 732 | A1 | 1/2004 |
| WO | 2004/100717 | A1 | 11/2004 |
| WO | 2004/100718 | A1 | 11/2004 |
| WO | 2005/058092 | A1 | 6/2005 |
| WO | 2005/079630 | A1 | 9/2005 |

* cited by examiner

DEVICE FOR CONTROLLING A MOVEMENT OF FURNITURE PARTS WHICH CAN BE MOVED WITH RESPECT TO ONE ANOTHER, AND PIECE OF FURNITURE

CROSS REFERENCE TO RELATED APPLICATIONS

This application is a continuation of International Application No. PCT/EP2007/003033, filed Apr. 4, 2007, which designated the United States, and claims the benefit under 35 USC §119(a)-(d) of German Application No. 20 2006 005 581.9, filed Apr. 4, 2006, the entireties of which are incorporated herein by reference.

FIELD OF THE INVENTION

The invention relates to a device for controlling the movement of furniture parts which can be moved with respect to one another, and to a piece of furniture including the device.

BACKGROUND OF THE INVENTION

Devices for controlling furniture parts which can be moved in a driven manner, in which a first furniture part can be moved in a driven manner relative to a second furniture part with the aid of a drive unit, are already known for example in the form of motor-driven drawers in cash registers.

SUMMARY OF THE INVENTION

The object of the invention is to provide devices for controlling the movement of furniture parts or pieces of furniture which can be moved with respect to one another, with the aim of improving the user-friendliness and allowing more flexible use of the pieces of furniture for various purposes.

The invention is based on a device for controlling the movement of furniture parts which can be moved with respect to one another, using a drive unit by means of which a first furniture part can be moved in a driven manner relative to a second furniture part via a monitoring unit for monitoring the movement of the first furniture part. The essence of the invention is that, after starting up, the monitoring unit operates in accordance with a monitoring program for monitoring the movement of the first furniture part, with selection means being provided by means of which an alternative selection program can be activated, instead of the monitoring program, in order to monitor the movement of the first furniture part. In the case of furniture parts which can be moved with respect to one another, this allows the first furniture part which can be moved in a driven manner to be matched to individual requirements and circumstances.

The monitoring unit is preferably designed such that, after it has been started up, the monitoring unit operates in accordance with a monitoring program that is preset for monitoring the movement of the first furniture part. In this case, it is advantageous that, after startup, either a monitoring program or standard program which has already been installed in advance, for example, in the factory, or some other selection program is provided, by which means the moveable first furniture part can be matched to various presets. A correspondingly equipped piece of furniture or the device for controlling the movement can therefore be set up flexibly with the starting-up process, in particular without any possibly complex adjusting measures, at the installation location of the piece of furniture, in a short time.

A user can retain a preset monitoring program and/or can use suitable selection means to select a monitoring program, in particular with a few control steps, and/or change to an alternative monitoring program, based on individual viewpoints. The selection program which is available for monitoring the movement of the first furniture part is, in particular, designed for full functionality with respect to monitoring the movement of the furniture parts which can be moved with respect to one another.

It is particularly advantageous for a plurality of alternative selection programs to be available, in particular three selection programs, by means of which it is generally possible to comply with the majority of the requirements which are important for a user.

It is particularly preferable for the monitoring unit to be designed such that the monitoring program and a plurality of selection programs are stored permanently for the selective activation thereof. This allows a user to change at any time and with little effort from the currently activated program to a different one of the plurality of permanently stored programs. Suitable memory capacities must be provided for the saving and storage of the programs, for example integrated in the monitoring unit.

It is also possible that the monitoring unit is designed such that, when used in the field, one of the plurality of stored programs can be activated at any time for monitoring the movement of the first furniture part. In particular, this measure makes it possible for a user to select the desired program from all the stored programs.

In the case of pieces of furniture with drawers, for example, a first selection program which can be selected for example via a beep tone can be selected, for example, for a flatware drawer whose weight when full is relatively low. In this case, a movement pattern could have an appearance such that rapid outward movement to ⅔ of the opening distance is carried out, followed by rapid closing again, after a time interval. A second selection program, which can be selected via two beep tones, could normally move out quickly to ¾ of the opening distance, and close normally. A selection program 3, which can be addressed for example by three beep tones, for example for heavy pedestal drawers, could move slowly to the full or maximum opening, and could then close slowly. The appropriate program can be selected by holding the drawer closed or by holding it open at the moment when the desired beep tone occurs.

In one preferred refinement of the invention, the monitoring unit is designed such that, when the monitoring unit is monitoring the movement of a plurality of first furniture parts, one of the stored programs can be activated selectively for each individual one of the plurality of first furniture parts. For example, this allows a piece of furniture having a plurality of moveable first furniture parts in each case to be matched to individual user requirements. By way of example, this may be advantageous for pieces of kitchen furniture with a plurality of drawers which can be moved in a driven manner, in particular when the individual drawers have different loads and differ in their frequency of use.

For the purposes of the invention, the expression monitoring unit means both a component which is responsible for monitoring the movement of a plurality of first furniture parts and possibly for all the existing first furniture parts, and in each case communicates with them, as well as a plurality of subunits which communicate with one another and are responsible for monitoring the movement of a plurality of first furniture parts, with one subunit in each case being associated with at least one first furniture part.

It is also possible that the monitoring unit is designed such that, when the monitoring unit is monitoring the movement of a plurality of first furniture parts, one of the stored programs can be activated selectively for a group comprising two or more of the first furniture parts. It is frequently advantageous in the case of a plurality of first furniture parts for the movement to be monitored using the same plan and/or the same program. In the case of pieces of kitchen furniture, for example, this may be the case for all the drawers at the top in the vertical direction of a plurality of drawers which are arranged alongside one another. By way of example, these drawers frequently have the common feature that they are used considerably more often by a user while, in contrast, drawers which are located at a lower level may need to be moved less frequently.

In one particularly preferred embodiment of the invention, the monitoring unit is designed such that program parameters can be defined in the stored programs. This allows a stored program to be specifically matched to appropriate presets, for example by a user. This makes it possible to operate with a comparatively relatively clear number of stored programs without needing to dispense with desired program contents and parameter settings by restricting the number of programs. For example, in addition to a monitoring program or standard program which may not be possible to modify subsequently, it is also possible to provide further selection programs, at least one of which or possibly a plurality of which allow the program parameters to be changed at any time.

The monitoring unit is preferably designed to store the program parameters. In this case, it is advantageous for the monitoring unit to be designed to store new program parameters. The program parameters which are entered retrospectively in a stored program are therefore available all the time, and can also be used again at any time during a subsequent change to other programs, without having to be re-entered.

The monitoring unit is preferably designed to define program parameters which comprise variables which govern the movement of the first furniture part. The governing variables for the definition of a movement profile for the first furniture part include, for example, a pulling-out movement, a speed, a movement run, an initiation time window or an activation or non-activation state of the automatic closing.

It is also preferable for the monitoring unit to be designed such that a selection program comprises a learning program in which a movement profile of the first furniture part can be defined. This not only makes it possible to achieve particularly good user-friendliness for the selection of different stored programs, but also provides a learning mode, or a "teach-in mode". The learning program can be used to define or to newly overwrite even relatively complex movement profiles for the first furniture part in a particularly simple manner and in a short time, and to store these in a selection program.

The monitoring unit is advantageously designed to define a distinguishing feature by means of which it is possible to distinguish between the movement pattern of the first furniture part with respect to a collision of the first furniture part with an object, and deliberate stopping of the first furniture part by a person. By way of example, a threshold value can be preset for characterization of the deceleration of the first furniture part caused by a collision, as a distinguishing feature.

It is also possible that the monitoring unit is designed to define parameters for setting a distance variable for the first furniture part, on the basis of which a stop position of the first furniture part is defined, for the situation in which an object is jammed between the first and the second furniture parts. In particular, this makes it possible to achieve effective and variable jamming protection. For example, after identifying a collision that has been caused by an object becoming jammed, the first furniture part can be stopped and moved back again or opened through a predetermined movement distance, in which case, by way of example, the opening movement distance is variable.

It is particularly preferable for the monitoring unit to be designed to define the movement profile of the first furniture part by means of a movement, which is carried out manually, of the first furniture part. This allows a user to define a movement profile for the relevant first furniture part particularly conveniently and without complication. In addition, adjustment steps which are otherwise necessary, for example by inputting numerical values or programming commands by a user, can be avoided. Furthermore, a multiplicity of information items can easily be defined precisely and in a short time by means of a movement of the first furniture part, which is carried out manually, even by a non-specialist, for example kitchen users. In addition, the movement of the first furniture part which is carried out manually, and the movement profile which is generated by this movement, can be assessed and influenced directly by a user immediately when this is done, therefore considerably simplifying the creation of a desired movement profile.

It is also possible that the monitoring unit is designed to receive speed and/or position information relating to the movement of the first furniture part which is being carried out manually. This measure makes it possible to produce a desired movement profile without any knowledge of absolute values with regard to speed and position information. In principle, the expression movement of the first furniture part should be understood as meaning an opening and a closing movement, or a forward and backward movement.

In particular, for example, opening and closing speeds and accelerations can be produced and supplied to and stored in the monitoring unit by means of a movement of the relevant first furniture part, which is carried out manually, in order to produce program parameters in a learning program. If required, this can be done as a function of a load state of the first furniture part, for example with the capability to generate program parameters matched to a load weight. Further program parameters which can be defined in an elegant form by the manual movement of the first furniture part under consideration include, for example, an opening distance, a delay to the movement, and the maximum speed, which can be defined by suitable devices and/or sensors during the manual movement of the first furniture part, and can be stored via a computation unit and/or the monitoring unit. It is particularly advantageous if the entire profile of the movement of the first furniture part which is carried out manually, together with all the detail information, can be recorded by means of the learning program.

In principle, the expression information, in particular information of widely differing types, should be understood as meaning, for example, control commands, encryption or access data, parameters for characterization of movement processes, characteristic variables or other variables.

It is also possible that the monitoring unit is designed to receive information in order to call up the learning program and to end it again. Only when in the called-up state can the learning program be used, for example, to create a new program or to overwrite an already existing program. In order to allow a user to define a start time for the learning program, there are various possible ways to enter the learning program mode. For example, the called-up state of the learning program may be accessed via peripheral devices, for example via a keypad. By way of example, a predetermined code may be supplied to the monitoring unit, by means of which the called-up state of the learning program is initiated. In principle, a code such as this should be understood as meaning information which is supplied directly or indirectly to the monitoring unit.

The monitoring unit is preferably designed to receive information via a telephone. In particular, the monitoring unit can advantageously be designed to identify the code for calling up and ending the learning program and/or to receive information of a different type, for example for definition of the program parameters, via a telephone link, via a mobile telephone or via fixed appliances.

One embodiment of the invention provides for the monitoring unit to be designed to receive information via a computation unit, in particular with an additional device.

Furthermore, it is advantageous for the monitoring unit to be designed to receive information via a memory card.

Alternatively, information can be produced and passed on to the monitoring unit via a computation unit, in particular with an additional device, for example by means of a screen, touch-screen, keypad, PDA or laptop, or via a memory card.

In one embodiment of the invention, the monitoring unit is designed to receive information via a handle element on the first furniture part.

The monitoring unit can also receive information via a switch on the first or second furniture part.

Furthermore, it is feasible for it to be possible to transfer information via a handle element on the first furniture part, for example by means of a switch which is integrated in a safety handle, for example on the inside of the safety handle. In principle, it is also feasible to have a learning or teach-in switch, which is specific or provided especially for this purpose, on one of the furniture parts.

The monitoring unit is advantageously designed to receive information via a unit which is superordinate to the monitoring unit. By way of example, a central computation station or a superordinate computer may be used as the superordinate unit. The superordinate unit may be part of the monitoring unit. Furthermore, the called-up state can be left at any time, and the end state of the learning program selected by means of the superordinate unit and/or by using the above-mentioned options for information transfer.

In a further preferred embodiment of the invention, the monitoring unit is designed to receive information by means of a predetermined movement of the first furniture part after a switch-on process, in particular within a predetermined time window. This makes it possible to provide different information items, for example information items for accessing the called-up state or the end state of the learning program.

For example, in a modified refinement of the monitoring unit, a moveable furniture part or a drawer can be pulled out manually within a predetermined time, for example within a few seconds, after a main switch has been switched on and current is passed through the device for controlling movement, thus accessing, for example, the called-up state or the end state of the learning program.

The monitoring unit is advantageously designed to receive information by means of a touching element which is operated for a predetermined time. For example, a keypad or a switch may be provided in which a key is arranged which must be pushed at least for a predetermined time interval in order, for example, to enter the called-up state or to leave it again.

The monitoring unit is preferably designed in order to receive and to verify coding signals, in order to receive information after the verification process. In particular in order to provide protection against impermissible or accidental access to the programs and in particular the learning program, the program selection and the called-up state of the learning program can be entered only after the correct code has been identified. In addition to transmission of the coding by means of one of the above-mentioned measures, it is also possible, for example, to operate the first furniture part or the drawer in a "coded" or predefined manner. For example, a coding can be produced by defined or various knocks, or by an operator pushing against the first furniture part or a drawer front for longer, for example, than three seconds.

In addition, the coding signals may comprise an audible signal. Coded operation of the first furniture part may also comprise more complex coding steps and/or a combination of different coding options.

The coding signals preferably comprise pressure signals exerted on the first furniture part.

The coding signals can advantageously be produced via a predetermined movement pattern of the first furniture part.

It is also possible that the coding signals are produced via a predetermined movement pattern of at least two first furniture parts.

For example, a first furniture part can be pressed three times successively for a few seconds, for example three to five seconds, in which case it is possible to press on one first furniture part or on two first furniture parts at the same time.

As a coding, a first furniture part can also, for example, be opened quickly for a predetermined time, although this depends on there being an appropriate handle element on the first furniture part. It is also feasible for a first furniture part to be opened and closed completely a plurality of times in a comparatively short time, in which case there must be a minimum pause of a predetermined time between two opening and closing processes.

Furthermore, any two or two defined first furniture parts can be pulled out from a closed position at the same time for coding, in which case the pulling-out process must occur within a time window of, for example, a few seconds.

It is also feasible to program a first furniture part or a drawer by pressing two first furniture parts, which are located one above the other, of another furniture housing at the same time in order to access the called-up state of the learning program. A first furniture part can also be opened and closed conventionally in order to identify a called-up state of the learning program. For example, the first furniture part can first of all be half-opened from a closed position, and can then be half-closed, or can be half-closed from an open position and opened again.

In order to enter the learning mode or the "teach-in mode", it is also feasible for the first furniture part, when in an open position, to be pulled by hand against a mechanical stop, or for the first furniture part to be pulled over a selected resistance. In the closed position, the called-up state can also be accessed by a person pressing against the front of the first furniture part for a minimum time.

The monitoring unit is preferably designed to acknowledge receipt of information by means of an audible and/or visual signal. In order to provide feedback when information has successfully been transferred by a person, it is possible, for example once the called-up state of the learning program has been accessed, to send one or possibly more successively perceptible beep tones or blinking light signals on the first or second furniture part. As acknowledgement of receipt of information, it is also possible to switch a light source on the first or second furniture part on or off.

The monitoring unit can advantageously be designed to acknowledge receipt of information by carrying out a defined movement process of the first furniture part. For example, when the learning program is in the learn-in mode or in the called-up state, it is particularly worthwhile, in order to acknowledge a movement pattern or a movement process of the first furniture part which has been defined by manual movement of the relevant furniture part, for the information to be provided by carrying out a defined movement process of the first furniture part. In particular, the movement process of the first furniture part, which was also stored, is in this case carried out accurately. This allows the learning success and the actually stored movement information to be assessed immediately.

It is also possible that the monitoring unit is designed to store a stored program for monitoring the movement of a first furniture part for a further first furniture part. This means that, once a program has been stored, it can easily be transferred to further furniture parts.

In order to check whether a movement pattern has actually been stored, it is possible for example to repeat a stored movement once again for acknowledgement purposes, with an acknowledgement by the user being required for definitive transfer of the movement which is temporarily stored first of all or most recently. The movement pattern which was stored first is finally stored in the appropriate program only after the acknowledgement process has been carried out. For example, the acknowledgement can be provided by a movement being carried out twice successively, and in the same way in terms of time and distance. The movement can be adjusted by pressing repeatedly, for example after being pressed for the first time, the movement pattern is repeated and, after being pressed for the second time, the learning mode is restarted, while the learn-in mode is left after pressing for the third time, and the movement pattern is stored.

In particular, the monitoring unit is designed in order to replace information which has already been stored for monitoring the movement of a first furniture part by new information. This allows a stored program to be overwritten at any time.

In order, for example, to transfer a stored program for a specific first furniture part to a different first furniture part, the already programmed first furniture part can be opened and then switched to the called-up state of the learning program, with a program start being initiated, and with the already programmed program being copied automatically. In principle, in order to copy already stored programs, a programming which was carried out most recently can be transferred to the next opened furniture part if the learning program has not been switched to the end state, and in particular this allows repeated further copying.

According to the invention, the monitoring unit is designed in particular in order to receive information about the speed of the movement of the first furniture part when the learning program is in the called-up state.

Furthermore, the monitoring unit is designed, when the learning program is in the called-up state, to receive information about movement stops or pulling-out movements during the movement of the first furniture part, about acceleration data relating to the movement of the first furniture part, about time intervals relating to an initiation action by a user, about a closing distance of the first furniture part in a closed position relative to the second furniture part, and about variables relating to a collision between the first furniture part and a further first furniture part.

In addition, the monitoring unit can be designed in order, when the learning program is in the called-up state, to receive information relating to the activation or deactivation of automatic closing of the first furniture part. With regard to speed data, a maximum speed or a speed which is dependent on a load weight of the relevant first furniture part can be processed as information.

It is also possible that the monitoring unit is designed, when the learning program is in the called-up state, to receive information relating to variables which are linked to the movement of the first furniture part, in particular, visual and/or audible variables. For example, a piece of music, a melody and/or a light and/or a lighting effect can be matched to the movement of the first furniture part.

The monitoring unit is advantageously designed, when the learning program is in the called-up state, to render inoperative functions for monitoring the movement of the first furniture part.

The monitoring unit is advantageously also designed, when the learning program is in the called-up state, to identify an end of the called-up state by a predetermined time interval having elapsed, in which no further input is made. This makes it possible, for example, for a learning program which has accidentally not been switched to the end state after completion of programming to be automatically switched to the end state without anybody having to do anything further. The non-automatic and/or automatic ending as well as the resulting called-up state of the learning mode can be indicated, for example, by means of an audible and/or visual signal to a user.

In one alternative advantageous refinement of the monitoring unit, when the learning program is in the called-up state, an end of the called-up state is identified by a predetermined time interval having elapsed, during which the first furniture part is held manually, in particular pressed, in a closed position.

It is also possible that the monitoring unit is designed, when the learning program is in the called-up state, to identify an end of the called-up state by activation of the superordinate unit.

In a further advantageous refinement of the invention, the monitoring unit is designed, when the learning program is in the called-up state, to identify an end of the called-up state by a movement process, which is carried out manually, of one of the first furniture parts.

It is also proposed that the monitoring unit be designed such that, when the learning program is in the called-up state, an end of the called-up state is signaled by means of an audible and/or visual signal.

The monitoring unit is preferably designed such that, when the learning program is in the called-up state, this is in each case valid only for one first furniture part.

It is also possible that the monitoring unit is designed such that, when the learning program is in the called-up state, this is valid for a plurality, in particular all, of the first furniture parts which are monitored by the monitoring unit.

In one preferred embodiment of the invention, the monitoring unit is designed such that the monitoring program can be activated again via a reset action. This means that it is simple and quick to revert back to the monitoring program or to a standard or basic program at any time, and possibly without having to carry out any further action. This can be helpful, for example, when problems occur in the creation of program profiles or in the event of a change from one program to a different program, in order in any case to guarantee the movement monitoring by means of the monitoring program and without having to risk a total failure of the movement monitoring. The monitoring program is for this purpose generally protected against a single change or against overwriting.

In addition, the invention relates to a piece of furniture having furniture parts which can be moved relative to one another, and having one of the above-mentioned devices. In particular, the invention relates to a piece of furniture with a moveable hatch, door or the like with a hinge or fitting unit for its guidance and with a drawer with a guide unit for guidance of the drawer on a furniture housing, with a drive unit in each case being provided by means of which this furniture part can be moved in a driven manner over at least a certain distance relative to the housing via a monitoring unit for monitoring the movement of the hatch, door or the drawer.

As a modern aid for operation of the device for controlling movement and for a corresponding piece of furniture, an Internet address can be stated on a part of the device or on the piece of furniture, in such a way that a user can identify this readily.

BRIEF DESCRIPTION OF THE DRAWINGS

Further advantages and features of the invention will be explained in more detail using the schematically illustrated figures, in which, in detail.

DETAILED DESCRIPTION OF THE INVENTION

Figure 1:
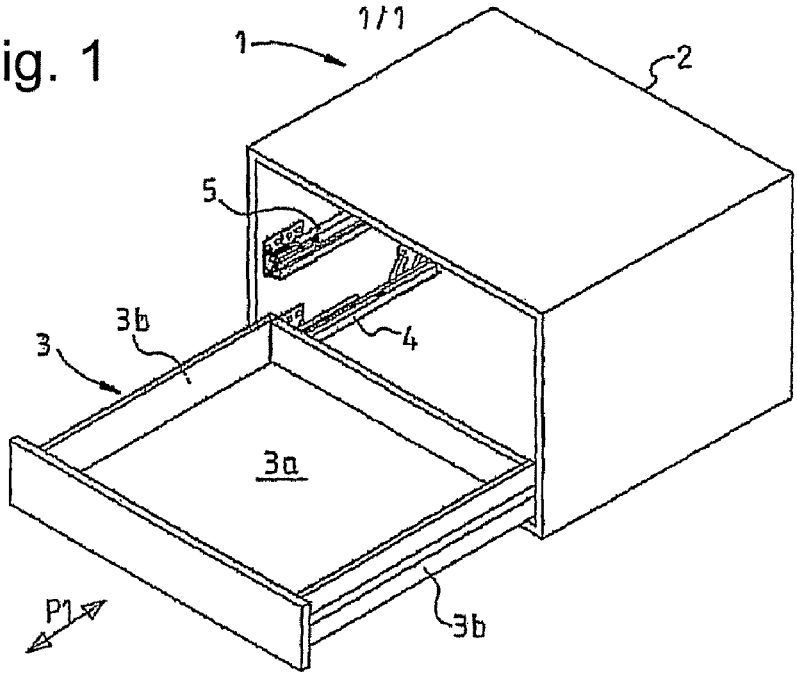
FIG. 1 is a perspective view of a piece of furniture according to the invention with a drawer, which can be moved in a housing.

FIG. 1 shows, obliquely from above, a piece of furniture 1 according to the invention having a housing 2 and a drawer 3 which is guided such that it can move in the housing 2. The drawer 3, which is arranged in the lower area of the housing 2, is illustrated in the open or pulled-out state, with the drawer 3 being moveable such that it can be shifted with respect to the housing 2, via a pulling-out fitting or a drawer guide 4. A further drawer (not shown) can be accommodated in the housing 2 via a further drawer guide 5, in a manner corresponding to the drawer 3. The drawer 3 can be moved, pulled out or pushed in relative to the housing 2, as indicated by the double-headed arrow P1. In order to hold and/or guide the movement of the drawer, the drawer guide 4 is in each case fitted on the drawer side in the lower area of drawer frames 3*b*, which project upward on both sides on a drawer bottom 3*a*. FIG. 1 shows only the respective drawer guides 4 and 5 which are attached to an inner face of the housing, that can be seen. The drawer 3 can be moved in a driven manner, in which case the drive unit (not shown) can be arranged for example in the rear area of the housing and/or on the drawer guides 4, 5.

Figure 2:
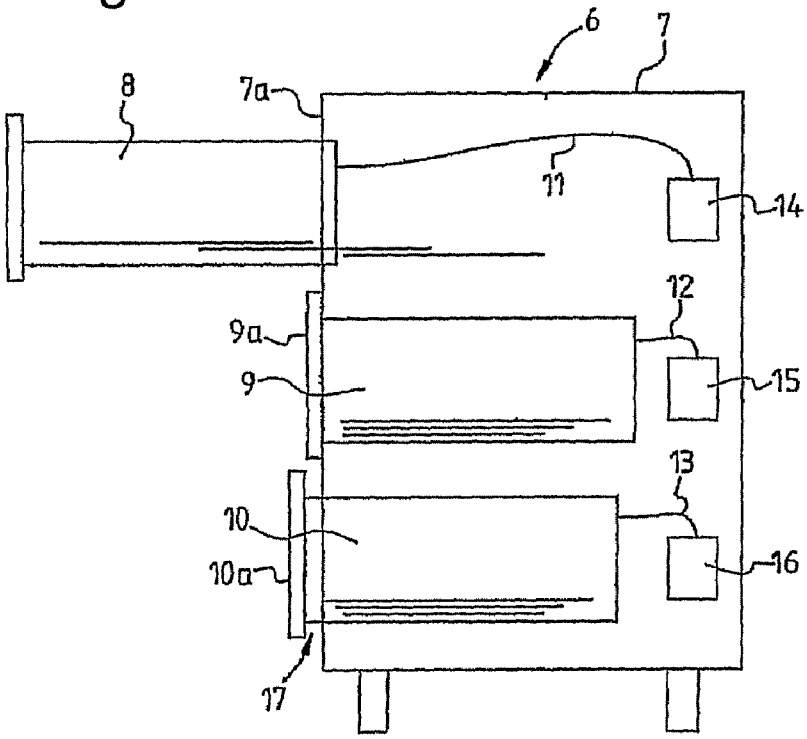
FIG. 2 shows a highly schematic section view from the side through a further embodiment of a piece of furniture according to the invention, with drawers which can be moved in a driven manner in a housing.

FIG. 2 shows a highly simplified and schematic illustration in the form of a side view of a further piece of furniture 6 according to the invention with a housing 7, with one side wall of the housing 7 having been omitted. Three drawers 8, 9 and 10 which can be moved in a driven manner and are arranged one above the other are accommodated in the housing 7. The drawers 8, 9 and 10 are respectively connected via drive elements 11, 12 and 13 to drive units 14 to 16, which are each associated with one of the drawers 8-10. For this purpose, each of the drive elements 11-13 acts on the one hand on a rear wall of the respective drawer 8-10, and on the other hand on the respective drive unit 14-16.

The drawer 8 is illustrated in a pulled-out state with respect to the housing 7, or in an open position. The drawer 9 is located in a closed position or is illustrated in a state in which it is located completely in the housing 7, with a drawer front 9*a* striking against a front edge 7*a* of the housing, in such a way that the front edge 7*a* forms a mechanical stop for the drawer front 9*a*.

The drawer 10 is moved out forward through a comparatively short distance, over a distance 17 between a drawer front 10*a* and the front edge 7*a*. This distance 17 may be necessary, for example, for push-operation of the drawer 10, for example when the drawer 10 can be operated by means of a so-called touch-latch system (not shown). In order to open the drawer 10, it is moved through a slight movement distance in the direction of the housing 7 by pushing on the drawer front 10*a*, as a result of which, after an initiation action, the drive unit 16 drives the drawer 10 forward via the drive element 13.

A monitoring unit for monitoring the movement of the drawers 8-10, and/or individual monitoring units which are associated with each drawer 8-10 and communicate with one another, are not illustrated in FIGS. 1 and 2. However, a monitoring unit may, for example, be accommodated in each of the drive units 14-16.

LIST OF REFERENCE SYMBOLS

1 Piece of furniture
2 Housing
3 Drawer
3*a* Drawer bottom
3*b* Drawer frame
4 Drawer guide
5 Drawer guide
6 Piece of furniture
7 Housing
7*a* Front edge
8 Drawer
9 Drawer
9*a* Drawer front
10 Drawer
10*a* Drawer front
11 Drive element
12 Drive element
13 Drive element
14 Drive unit
15 Drive unit
16 Drive unit
17 Distance

We claim:

1. A device for controlling the movement of furniture parts which can be moved with respect to one another, comprising a drive unit for moving a first furniture part in a driven manner relative to a second furniture part, a monitoring unit for monitoring the movement of the first furniture part, wherein the monitoring unit, after starting up, operates in accordance with a monitoring program for monitoring the movement of the first furniture part, and selection means by which an alternative selection program can be activated, instead of the monitoring program, to monitor the movement of the first furniture part, wherein the monitoring unit further comprises memory for storing all information for controlling the movement of the first furniture part and said information is available at startup, wherein the alternative selection program comprises a learning program by which a movement profile of the first furniture part is defined and wherein the monitoring unit receives information in order to call up and end the learning program.

2. The device as claimed in claim 1, wherein, after starting up, the monitoring unit operates in accordance with the monitoring program that is preset for monitoring the movement of the first furniture part.

3. The device as claimed in claim 1, wherein the monitoring program and a plurality of selection programs are stored permanently for the selective activation thereof, such that one of the plurality of stored programs can be activated at any time for monitoring the movement of the first furniture part.

4. The device as claimed in claim 3, wherein program parameters are defined in the stored programs.

5. The device as claimed in claim 1, wherein, when the monitoring unit is monitoring the movement of a plurality of first furniture parts, one of the stored programs can be activated selectively for each individual one of the plurality of first furniture parts, or for a group comprising two or more of the first furniture parts.

6. The device as claimed in claim 1, wherein the monitoring unit distinguishes between the movement pattern of the first furniture part with respect to a collision of the first furniture part with an object, and deliberate stopping of the first furniture part by a person.

7. The device as claimed in claim 1, wherein the monitoring unit defines a movement profile of the first furniture part by means of a movement, which is carried out manually, of the first furniture part.

8. The device as claimed in claim 1, wherein the monitoring unit receives information via at least one of a telephone, an additional device, and a memory card.

9. The device as claimed in claim 1, wherein the monitoring unit receives information via a unit which is superordinate to the monitoring unit.

10. The device as claimed in claim 1, wherein the monitoring unit receives and verifies coding signals in order to receive information after a verification process.

11. The device as claimed in claim 1, wherein the monitoring unit acknowledges receipt of information by means of at least one of an audible and visual signal, or by carrying out a defined movement of the first furniture part.

12. The device as claimed in claim 1, wherein the monitoring unit stores a program for monitoring the movement of a first furniture part to be used for a different first furniture part.

13. The device as claimed in claim 1, wherein the monitoring unit replaces information which has already been stored for monitoring the movement of a first furniture part by new information.

14. The device as claimed in claim 1, wherein when the learning program is in a called-up state, the monitoring unit identifies an end of the called-up state after a predetermined time interval has elapsed, in which no further input is made or during which the first furniture part is held manually pressed in a closed position.

15. The device as claimed in claim 1, wherein when the learning program is in a called-up state, the monitoring unit identifies an end of the called-up state by activation of a superordinate unit.

16. The device as claimed in claim 1, wherein when the learning program is in a called-up state, the monitoring unit identifies an end of the called-up state by a movement process, which is carried out manually, of one of the first furniture parts.

17. The device as claimed in claim 1, wherein when the learning program is in a called-up state, the monitoring unit signals an end of the called-up state by means of at least one of an audible and visual signal.

18. The device as claimed in claim 1, wherein when the learning program is in a called-up state, the learning program applies to a single first furniture part or to a plurality of first furniture parts which are monitored by the monitoring unit.

19. The device as claimed in claim 1, wherein the monitoring program can be activated via a reset action.

20. A piece of furniture comprising the device as claimed in claim 1.

* * * * *